United States Patent [19]

Ginsburgh et al.

[11] 4,184,548

[45] Jan. 22, 1980

[54] METHOD FOR DETERMINING THE POSITION AND INCLINATION OF A FLAME FRONT DURING IN SITU COMBUSTION OF AN OIL SHALE RETORT

[75] Inventors: Irwin Ginsburgh, Morton Grove; Christos G. Papadopoulos, Lisle, both of Ill.

[73] Assignee: Standard Oil Company (Indiana), Chicago, Ill.

[21] Appl. No.: 925,065

[22] Filed: Jul. 17, 1978

[51] Int. Cl.[2] ..... E21B 43/24; E21B 47/10

[52] U.S. Cl. ..... 166/251

[58] Field of Search ..... 166/251, 252, 256, 64

[56] References Cited

U.S. PATENT DOCUMENTS

| | | | |
|---|---|---|---|
| 2,770,305 | 11/1956 | Pirson | 166/251 |
| 2,800,183 | 7/1957 | Jenkins | 166/251 |
| 2,803,305 | 8/1957 | Behning et al. | 166/251 |
| 3,031,762 | 5/1962 | Parker | 166/251 X |
| 3,072,184 | 1/1963 | Parker | 166/251 |
| 4,082,145 | 4/1978 | Elkington | 299/2 X |

OTHER PUBLICATIONS van Poolen, "Transient Tests Find Fire Front in an In Situ Combustion Project", *The Oil & Gas Journal,* vol. 63, No. 5, Feb. 1, 1965, pp. 78–80.

*Primary Examiner*—Stephen J. Novosad
*Attorney, Agent, or Firm*—Robert B. Stevenson; Arthur McIlroy

[57] ABSTRACT

A method for locating the position of a flame front within a rubbled oil shale retort of known dimension and location during an in situ combustion of the retort involving initiating a seismic signal at a selected position on the earth's surface relative to the retort, detecting the reflected seismic energy, and determining the position of the flame front by virtue of a maximum in the received reflected/refracted seismic signal. Repeating the process at a plurality of positions relative to the burning retort establishes the inclination of the flame front.

2 Claims, 2 Drawing Figures

METHOD FOR DETERMINING THE POSITION AND INCLINATION OF A FLAME FRONT DURING IN SITU COMBUSTION OF AN OIL SHALE RETORT

BACKGROUND OF THE INVENTION

1. Field of the Invention

This invention relates to the detection and control of a combustion or flame front being advanced through a subterranean combustible carbonaceous stratum. Specifically, this invention relates to the detection and control of a combustion or flame front during the utilization of in situ combustion techniques. More specifically, this invention relates to detection and control of a flame front during an in situ retorting of oil shale.

2. Description of the Prior Art

The term oil shale refers to sedimentary deposits containing organic materials which can be converted to oil. Oil shale contains an organic material called kerogen, which is a solid carbonaceous material from which shale oil can be retorted. Upon heating oil shale to a sufficient temperature, kerogen is decomposed and a liquid and/or gaseous hydrocarbon product is formed.

Oil shale can be found in various places throughout the world, especially in Colorado, Utah, and Wyoming. Some significant deposits can be found in the Green River formation in Piceance Basin, Garfield and Rio Blanco counties in northwestern Colorado.

Oil shale can be retorted to form hydrocarbon liquid either by in situ or surface retorting. In surface retorting, oil shale is mined from the ground, brought to the surface, and placed in vessels where it is contacted with hot retorting gases. The hot retorting gases cause shale oil to be freed from the rock. Spent retorted oil shale, which has been depleted in kerogen is removed from the reactor and discarded.

In situ combustion techniques are being applied to shale, tar sands, Athabasca sand and other strata in virgin state, to coal veins by fracturing, and to strata partially depleted by primary and even secondary and tertiary recovery methods.

In situ retorting oil shale generally comprises forming a retort or retorting area underground, preferably within the oil shale zone. The retorting zone is formed by mining an access tunnel to or near the retorting zone and then removing a portion of the oil shale deposit by conventional mining techniques. About 5 to 40%, preferably about 15 to 25%, of the oil shale in the retorting area is removed to provide void space in the retorting area. The oil shale in the retorting area is then rubbled by well known mining techniques to provide a retort containing rubbled shale for retorting.

A common method for forming an underground retort is to undercut the deposit to be retorted and remove a portion of the deposit to provide void space. Explosives are then placed in the overlying or surrounding oil shale. These explosives are used to rubble the shale preferably forming a uniform particle size. Some of the techniques used for forming the undercut area in the rubbled area are room and piller mining, sublevel caving, and the like.

After the underground retort is formed, the pile of rubbled shale is subjected to retorting. Hot retorting gases are passed through the rubbled shale to effectively form and remove liquid and gaseous hydrocarbons from the oil shale. This is commonly done by passing a retorting gas such as air or air mixed with steam and/or hydrocarbons through the deposit. Most commonly, air is pumped into one end of the retort and a fire or flame front initiated. This flame front is then passed slowly through the rubbled deposit to effect the retorting. Not only is shale oil effectively produced, but also a mixture of off gases from the retorting is formed. These gases contain carbon monoxide, ammonia, carbon dioxide, hydrogen sulfide, carbonyl sulfide, and oxides of sulfur and nitrogen. Generally, a mixture of off-gases, water and shale oil are recovered from the retort. This mixture undergoes preliminary separation commonly by gravity to separate the gases, liquid oil, and water. The off-gases commonly contain entrained dust and hydrocarbons, some of which are liquid or liquifiable under moderate pressure, the off-gases usually have a very low heat content of less than about 100 to about 150 BTU per cubic foot.

One problem attending shale oil production in in situ retorts is that the flame front may channel through more combustionable portions of the rubble faster than others. The resulting uneven passage of the flame front can leave considerable portions of the rubbled volume bypassed and unproductive. Such channeling can result from non-uniform size and density distributions in the rubbled shale. If the shape of the flame front can be defined or packing variations detected within the retort, then channeling and its effects can be mitigated by controlling the air injection rate and the oxygen content in various sectors of the retort, or secondary rubbling if regions of poor density can be mapped.

A variety of prior art techniques have been established for determining the position and progress of underground combustion. These techniques range from indirect theoretical mathematical formulations on one hand, to rather simplistic direct measurement that can be done at the combustion site on the other. One example of the mathematical treatment can be found in a paper by Hosslin Kazemi, delivered in 1965 at the Society of Petroleum Engineers Conference. Kazemi disclosed a method by which the distance from the measuring point to the combustion front could be calculated employing pressure transient measurements. In particular, the pressure fall-off observed at the bottom of the well hole in either injected liquid or in effluent gases could be related to the approach of the combustion front. Such pressure build-up and fall-off measurements were also described by H. K. Van Poolen in the Feb. 1, 1965, *Oil and Gas Journal.*

An equally elaborate technique was described by Dr. Feder in 1967 using an infrared system to locate subterranean thermal front when an infrared sensor is flown over the investigated area. Thermal energy from a subsurface hear source (combustion or steam fronts) may be transferred to the terrain surface by conduction through the overburden formation, or by movement of heated water or gases to the surface via fractures. Infrared imaging would then be useful to identify the hot portions of the surface terrain. This method however, is only a gross estimate for the position of the underground thermal front, and does not determine the position of the flame front with sufficient accuracy to determine channeling or inclination of the flame front.

U.S. Pat. No. 3,031,762 discloses the periodic measurement of the elevation of the ground at one or more points directly above the path of a combustion front until the ground at this point rises. Such a rise is interpreted to indicate the arrival of the combustion front directly under the elevated point. This method is dependent on the fact that combustion of carbonaceous stratum causes expansion of the stratum which is substantially immediately translated to a rise in the elevation of the ground surface directly above the expansion stratum. This method is uniquely applicable to combustion fronts which are primarily vertical and which move in a horizontal direction. Combustion fronts in the horizontal plane that propagate vertically would simply result in a roughly symmetrical elevated area with no information provided considering the depth or speed of the front.

U.S. Pat. No. 3,072,184 discloses a fuel pack in which separate masses of gas forming material are spaced in the fuel pack at predetermined distances. Thus as the fuel pack burns, it releases identifiable gases at spaced intervals which, when detected in the effluent gases can be related to the progress of the combustion front in that particular fuel pack. This method is primarily useful in well bores and is not readily amenable to application in underground retorting.

U.S. Pat. No. 3,454,365 discloses a method in which the gas from in situ combustion process is analyzed for its oxygen, carbon dioxide, hydrogen and hydrocarbon content. A small sample stream from a hot effluent during in situ combustion is treated, condensed and dried. It is subsequently analyzed to determine the relative concentrations of the various off-gases. This concentration level is then rationalized through a control computer which controls the air injection rate to maintain an optimum utilization of the oxygen in the air stream and to optimize the in situ cracking process. This process is directed primarily towards detecting the efficiency or effectiveness of the combustion process within the retort, and does not provide usable information concerning the speed, progress, extent or location of the flame front within the retort.

U.S. Pat No. 3,467,189 also employs a sample-and-analyze technique to detect the approach of the flame front. Physical properties such as the water to air ratio of the formation fluids which enter a production well are monitored, as well as the hydrogen ion concentration and the salinity of the water and the specific gravity of the liguid hydrocarbons. A signal indicating the close proximity of the combustion front to the production well is provided when limiting or static values are reached at the same time in any two of the physical properties of the formation fluids entering the production valve.

U.S. Pat. No. 3,483,730 employs thermocouples to monitor the change in temperature of the overburden near the ground surface at a plurality of points spaced around the point at which the combustion is initiated. These thermocouples respond to changes in the temperature of the overburden during movement of the underground combustion and thereby detect lateral displacement of the flame front.

Related to the teachings of U.S. Pat. No. 3,483,730 is a method involving a downhole placement of temperature-sensing devices which indicate a sharp rise in temperature as the flame front arrives at the locus of the temperature-sensing device. One disadvantage in this method lies in the fact that the extremely high temperatures of the combustion front frequently destroy the temperature-sensing apparatus. Another disadvantage is in the cost of drilling holes to the formation level.

The techniques of self-potential profiling, long used to locate mineral deposits, has recently been found to be useful as a tool for locating buried geothermal reservoirs. This technique involves the detection of small self-potential voltages, which result from natural earth currents. Two metal stakes are placed in conductive ground and connected to a sensitive voltmeter which detects the generation of electromotive force in the surrounding rocks due to increase in temperature. The effective range of this method is somewhat limited and dependent upon a large area of thermal variation to generate a measureable voltage. In an underground retort however, very poor electrical coupling exists between the rubble and the retort walls. Any self-potential voltages generated within the retort will be poorly transmitted to the walls. Therefore, self-potential voltages detectable by the surface sensors will be primarily those generated from the immediate adjacent retort walls (a much smaller thermal source than the entire flame front). This significantly reduces the efficacy of this method in underground retorting. Like the infrared imaging technique, this method adequately detects the presence of thermal anomalies, but provides little information concerning the depth or movement of such thermal fronts.

Scientists at the Lawrence Livermore Laboratories have recently explored the use of high frequency electromagnetic probing to investigate underground anomalies. One application of the radio frequency (RF) probing is to observe the progress of a burn front in the experimental underground coal gasification process. This technique involves lowering radio transmitters and receivers into bore holes drilled around the area of concern. Underground irregularities which have an effect on the passage of the RF waves can then be detected and located. Varying geological features, however, also affect the passage of RF waves. In addition, underground water pockets, or any other interface causing a change in the dielectric constant, would also affect the passage of RF waves. This method is therefore susceptible to interference caused by the presence of normal subterreanen features.

It can be seen that the methods taught by the prior art are, in general, directed towards either (1) detecting lateral movement of a flame front, or (2) the vertical movement of a flame front, but not both. In addition, even those methods which are capable of detecting directional movement and location of the front do not provide means for ascertaining whether the front is tilted out of the desired orientation. Such tilts are undesirable as they can cause incomplete or inefficient combustion in the retort. In general, the prior art does not provide a means for detecting both lateral and vertical locations of a flame front, the speed with which the flame front is propagating through the carbonaceous stratum and the degree to which the front deviates from the desired horizontal or vertical plane. Once these parameters in the underground flame front are detected, various means can be employed to selectively speed up or hinder portions of this flame front to more efficiently effectuate the retorting process.

This invention is concerned with a method of determining the progress and pattern of a combustion front in a carbonaceous stratum which avoids the aforesaid difficulties.

SUMMARY OF THE INVENTION

In accordance with this invention, there is provided a method for determining the position and inclination of a flame front being propagated through a rubbled oil shale retort during an in situ combustion of a retort. The rubbled oil shale retort being monitored in the present invention is envisioned as a well defined, carefully prepared underground rubbled zone of oil shale surrounded by an undisturbed oil shale deposit. As such, the position and dimensions of the retort are known and the transition from the undisturbed shale to rubbled shale at the sidewalls of the retort represent a significant acoustical interface, i.e., major change in acoustical impedance.

According to the present invention, a seismic signal is initiated towards a sidewall of the retort along which the flame front within the retort is known to traverse. The position of the initiation of this seismic signal is selected relative to the retort sidewall to satisfy two criteria. It is selected such that the seismic energy being reflected from the formation-retort sidewall interface in the region of said interface other than that region adjacent to the flame front position is predominantly away from the seismic detector means being employed to detect this reflection. Also, the position is selected such that the relative amount of seismic energy being directed to the seismic detector means from the region of the interface adjacent to the flame front position is enhanced by the high temperature induced refraction of the seismic signal occurring in that region. After detecting the reflected seismic signal as a function of time by use of the seismic detector means, the position of the flame front is determined from the reflected seismic energy.

In one specific embodiment of this invention, the oil shale retort is an essentially vertical retort having essentially vertical sidewalls and the flame front is intended to be essentially a horizontal plane passing vertically through the retort during in situ combustion. In this embodiment, the seismic signal is initiated at or near the earth's surface at a position to one side of the vertical sidewall such that the angle of incidence of the seismic signal to the sidewall results in predominantly downward reflected seismic energy in a region not adjacent to the flame front. But in the region adjacent to the flame front, the high temperature induced refraction of the seismic signal results in an angle of incidence which approaches zero, thus enhancing the relative amount of seismic energy being reflected back to the surface of the earth.

In another embodiment of the invention, the previous described steps are repeated at more than one position relative to the rubbled oil shale retort such that the inclination of the flame front can be determined.

DESCRIPTION OF THE PREFERRED EMBODIMENTS

Figure 1:
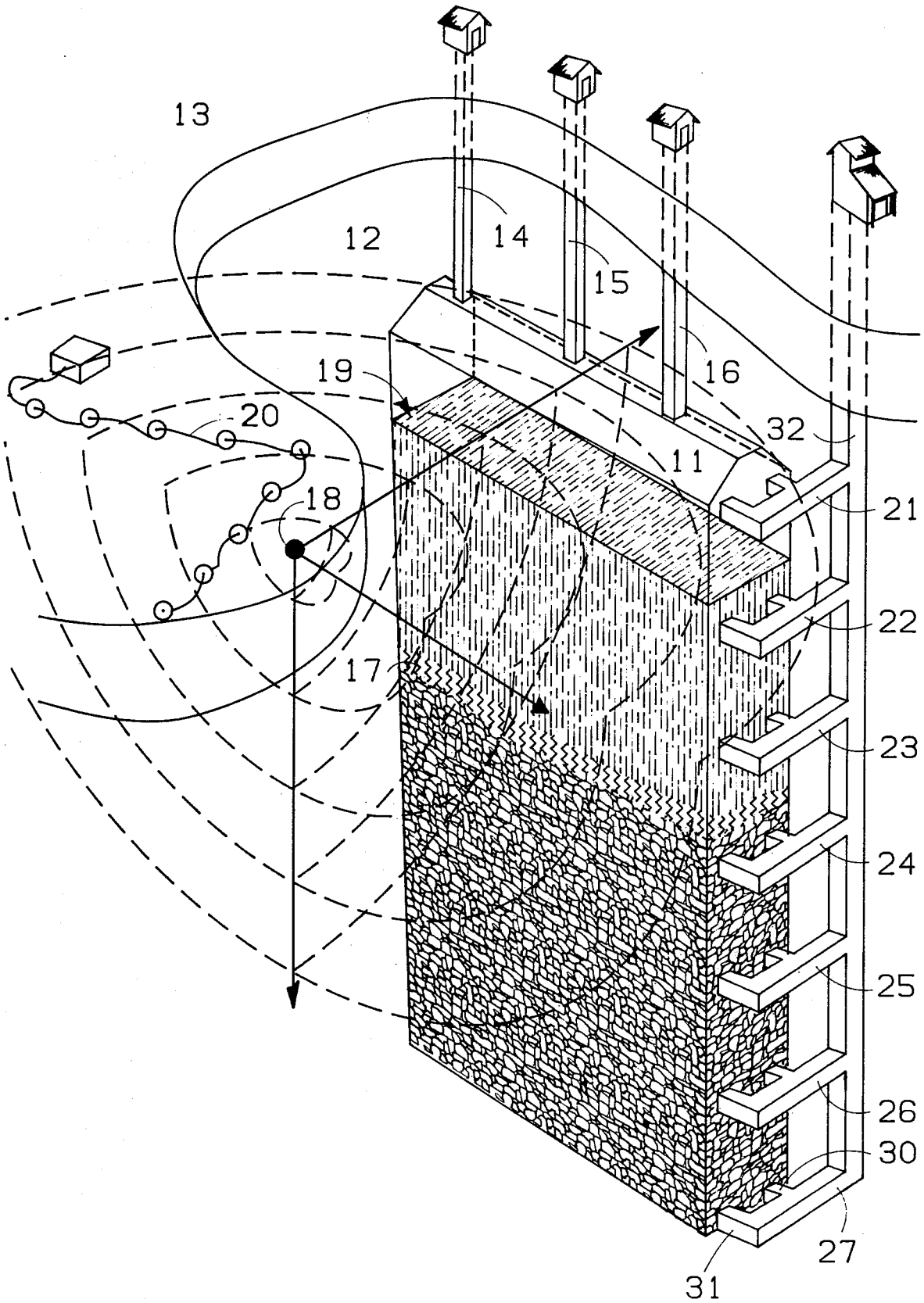
FIG. 1 is a cutaway view illustrating a subterranean oil shale formation containing a rubbled oil shale retort during in situ combustion wherein the position of the flame front within the retort is being monitored by initiating a seismic signal on the earth's surface and detecting the reflected/refracted signal from the retort sidewall.

In FIG. 1, there is shown an underground shale retort 11 in which an in situ combustion process to recover liquid and gaseous hydrocarbons is taking place. The retort 11 is of known dimension and position in that it was initially created by mining approximately 20% by volume of the shale deposit 12 within the retort by use of mine shafts 21 through 27, located at various depths. The actual construction of the rubbled retort 11 can be done by convention mining techniques well known in the art. In general, the respective mine shafts 21 through 27 are built with one or more horizontal drifts (e.g. 30 and 31) being driven through the width of the retort 11. A vertical starting slot to provide a free blasting surface is drilled at the far end of each drift. Fan drilling vertically upward and blasting to create the rubbled zone is performed as withdrawal from the drift takes place. This process is then repeated on the next lower level until the entire rubbled retort is established. The volume of shale removed, in principle, establishes the net void space (porosity or density) of the resulting retort. The particle size of the rubble is controlled by drilling and blasting parameters with a two foot or less particle size being desirable.

Oxygen for the in situ combustion is supplied by pumping air from the surface 13 through shafts 14, 15 and 16 to the top of the retort 11. During combustion a horizontal flame front 17 is sustained which moves downward through the rubbled oil shale retort 11. The hot combustion products from the flame front move downward heating the oil shale to a temperature of about 900° F., which results in kerogen releasing gases and liquid hydrocarbons which are also swept downward through the retort, leaving a coke-like structure behind. The hydrocarbons are recovered at the lowest level 27 and are delivered back to the surface through the appropriate shaft 32. Preferably, the hydrocarbons can be separated below ground (not shown) prior to being pumped to the surface for further treatment. The remaining coke-like material serves as the fuel to sustain the flame front.

Figure 2:
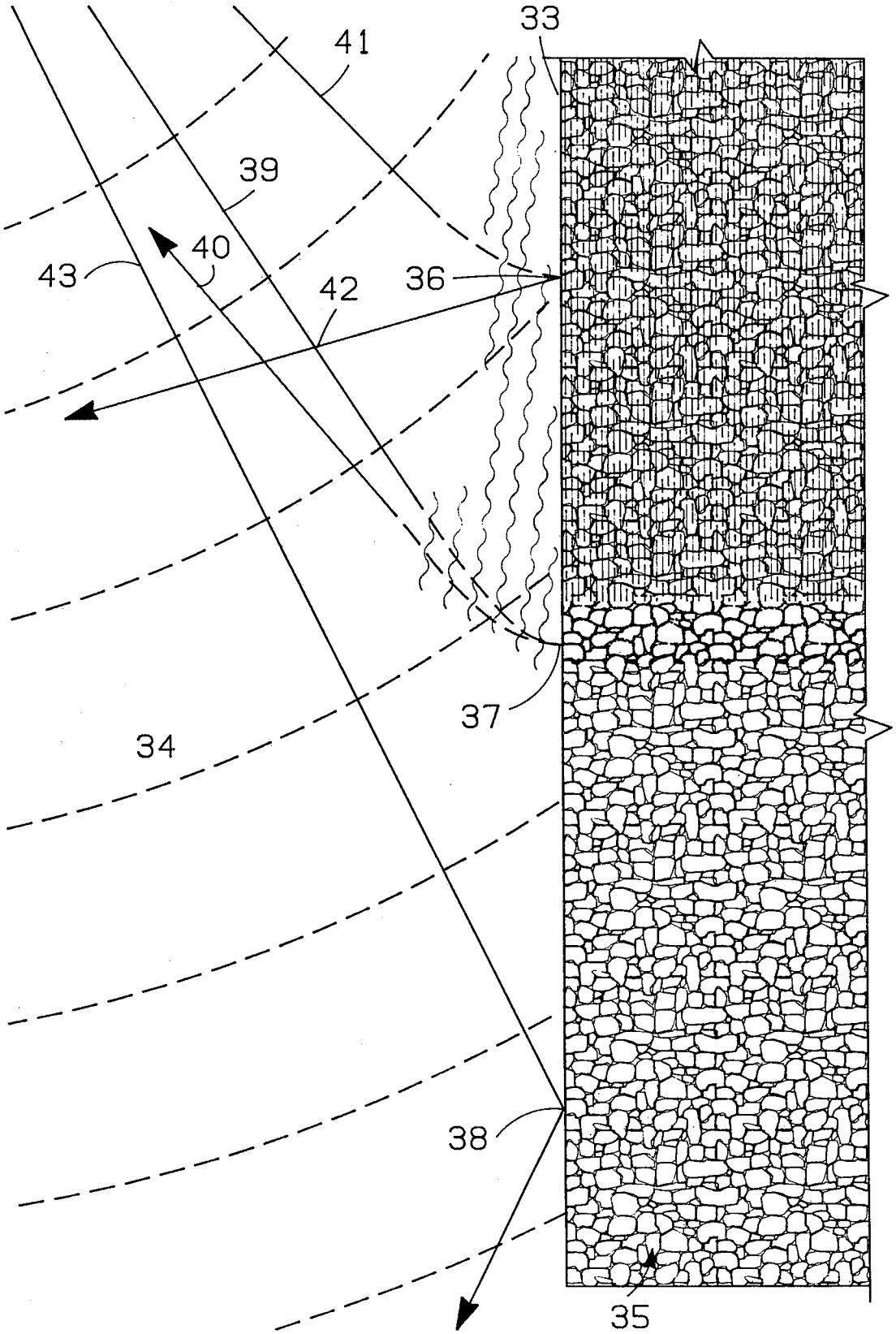
FIG. 2 is a cutaway view illustrating the effect of the refraction on the incident beam and reflected beam at various regions along the retort sidewall.

As shown in FIG. 1, a seismic source 18 is initiated at or near the earth's surface. The seismic energy radiates downward through the earth striking the retort sidewall interface 19. The reflected signal is then detected and recorded at surface seismometers 20. As shown in FIG. 2, the downward traveling seismic wave front will strike the interface 33 between the shale deposit 34 and the sidewall of the rubbled retort 35 and be reflected in a different manner depending upon whether it strikes above the flame front 36, at the flame front 37, or below the flame front 38. As illustrated, the incident beam 39 in the region of the flame front 37 will pass through the shale deposit 34 which has been elevated in temperature because of the presence of the flames. Since sound travels faster in hot shale relative to cool shale, the seismic signal will be refracted toward the interface, i.e., the angle of incidence will decrease and the beam will strike the sidewall more perpendicularly. Consequently, the reflected beam 40 will be relatively back reflected along a path sufficiently parallel to the incident beam 39 that the transition of the incident wave front from the region of flame front 37 to the lower unburned oil shale 38 will be observed as an anomaly in the intensity or amplitude of the reflected seismic energy. To a lesser extent, the region above the flame front 36 will result in temperature induced refraction of incident beam 41, but the predominant direction of the reflected seismic energy 42 will be away from the seismometers. In a region below the frame front, the incident beam 43 will be reflected downward.

Thus, according to the present invention, the position of the seismic source and the seismic detector means is selected such that the angle of incidence of the injected seismic signal to the sidewall of the retort results in the reflected seismic energy being reflected predominantly downward away from the seismic detector means except in the region adjacent to the flame front. In this region, the presence of the flame front heats the surrounding shale deposit, which in turn induces refraction of the seismic signal resulting in an angle of incidence which approaches zero degrees, thus optimizing the amount of back reflection toward the seismic detecting means. In this manner, the sequential transition of reflecting seismic energy from the hot sidewall of the retort near the flame front followed by reflecting the cooler retort sidewall below the flame front represents a sharp acoustic reflection anomaly. Measuring this anomaly establishes the relative position of the flame front during the burning of the retort. Repeated measurements from different positions and different sidewalls will establish the inclination of the flame front. Repeated measurement as a function of time will establish the rate of propagation and the direction of the movement of the flame front.

In commercial applications of the present invention, knowing the underground position of the retort plays a significant role in selecting the surface positions of the seismic source and seismic detectors. The seismic source should be located from several hundred to several thousand, preferably from about 500 to 1,000, feet away from the edge of the underground retort. Since extensive mining and drilling of the region has been performed in preparing the rubbled retort, the relative position of the retort will be known and the nature of the overburden will be well defined. Thus, an average acoustic velocity and refractivity as a function of temperature use for interpretative purposes will be available. The seismic detectors can be positioned on or near the surface according to the predicted optimum back reflection occurring at the flame front position.

The seismic detector means to be employed in the present invention can be any of the well known seismometers commonly used in seismic exploration, including geophones, hydrophones, and the like. The seismic source can be any of the well known seismic signals generated by explosion, implosion, Vibroseis® and the like, preferably a dynamite charge is utilized.

Having thus described the preferred embodiments, it should be apparent to one skilled in the art of seismic exploration and seismic interpretation that a great number of modifications in details of the foregoing procedures (not mentioned herein) may be made without departing from the scope of our invention. As such, this disclosure and associated claims should not be interpreted as being unduly limiting.

We claim:

1. A method for determining the position of the flame front during an in situ combustion of a rubbled oil shale retort wherein said rubbled oil shale retort is constructed essentially vertical of known dimensions and known position having essentially vertical sidewalls and said flame front is intended to be an essentially horizontal plane passing vertically through said retort during combustion involving the steps of:

(a) initiating a seismic signal on or near the surface of the earth at a position to one side of an essentially vertical sidewall of said retort such that the angle of incidence of the seismic signal to said sidewall inherently results in predominantly downward reflected seismic energy, (b) positioning at least one seismic detector means on or near the surface of the earth at a second position to the same side of said essentially vertical sidewall intended to reflect said seismic signal, (c) detecting the reflected seismic energy as a function of time by using said seismic detector means, and (d) determining the position of said flame front from the enhancement of the relative amount of seismic energy being reflected back to the surface of the earth associated with high temperature induced refraction of said initiated seismic signal which occurs in the vicinity of the flame front.

2. A method of claim 1 wherein said initiating of seismic signal with associated detecting of the reflected seismic energy and determining of the position of the flame front is repeated at more than one position relative to said rubbled oil shale retort such that the inclination of the flame front can be determined.

* * * * *